US008258896B2

(12) United States Patent
Soora

(10) Patent No.: US 8,258,896 B2
(45) **Date of Patent: *Sep. 4, 2012**

(54) HAIRPIN MICROSTRIP BANDPASS FILTER

(75) Inventor: Shruthi Soora, Raleigh, NC (US)

(73) Assignee: Harris Stratex Networks, Inc., Morrisville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,986

(22) Filed: May 24, 2011

(65) Prior Publication Data

US 2011/0279199 A1 Nov. 17, 2011

Related U.S. Application Data

(60) Continuation of application No. 12/715,328, filed on Mar. 1, 2010, now Pat. No. 7,965,158, which is a division of application No. 11/600,167, filed on Nov. 16, 2006, now Pat. No. 7,688,162.

(51) Int. Cl.
*H01P 1/203* (2006.01)
*H01P 1/205* (2006.01)

(52) U.S. Cl. ..... 333/203; 333/204

(58) Field of Classification Search ..... 333/202, 333/203, 204, 205, 219
See application file for complete search history.

(56) References Cited

U.S. PATENT DOCUMENTS 7,965,158 B2 * 6/2011 Soora ..... 333/204

* cited by examiner

*Primary Examiner* — Stephen Jones
(74) *Attorney, Agent, or Firm* — Sheppard, Mullin, Richter & Hampton, LLP

(57) ABSTRACT

A microstrip filter having a plurality of hairpin microstrip resonators each having two substantially rectangular legs connected at one end and generally configured in a "U" shape. The microstrip filter may comprise a first of the plural resonators operatively connected to a first feed point, a second of the plural resonators operatively connected to a second feed point, and a third of the plural resonators operatively connected between the first and second resonators where an end portion of one of the legs of one of the resonators is tapered so that a thickness of the one leg is greater at one end of the one leg than at another end of the one leg.

22 Claims, 15 Drawing Sheets

HAIRPIN MICROSTRIP BANDPASS FILTER

CROSS REFERENCE TO RELATED APPLICATIONS

This application is a continuation and seeks benefit and priority to U.S. nonprovisional application Ser. No. 12/715,328, entitled "Hairpin Microstrip Bandpass Filter," filed Mar. 1, 2010 now U.S. Pat. No. 7,965,158, which is a divisional application of U.S. nonprovisional application Ser. No. 11/600,167, issued on Mar. 30, 2010 as U.S. Pat. No. 7,688,162, entitled "Hairpin Microstrip Bandpass Filter," filed Nov. 16, 2006, which are all hereby incorporated by reference herein.

BACKGROUND

Filters are commonly utilized in the processing of electrical signals. For example, in communications applications, such as microwave applications, it is desirable to filter out the smallest possible passband and thereby enable dividing a fixed frequency spectrum into the largest possible number of bands.

Historically, filters have fallen into three broad categories. First, lumped element filters utilize separately fabricated air wound inductors and parallel plate capacitors, wired together to form a filter circuit. These conventional components are relatively small compared to the wave length, and thus provide a compact filter. However, the use of separate elements has proved to be difficult to manufacture, resulting in large circuit to circuit variations. The second conventional filter structure utilizes three-dimensional distributed element components. These physical elements are sizeable compared to the wavelength. Coupled bars or rods are used to form transmission line networks which are arranged as a filter circuit. Ordinarily, the length of the bars or rods is ¼ or ½ of the wavelength at the center frequency of the filter. Accordingly, the bars or rods can become quite sizeable, often being several inches long, resulting in filters over a foot in length. Third, printed distributed element filters have been used. Generally, they comprise a single layer of metal traces printed on an insulating substrate, with a ground plane on the back of the substrate. The traces are arranged as transmission line networks to make a filter. Again, the size of these filters can become quite large. These filters also suffer from various responses at multiples of the center frequency.

Prior art filters have historically been fabricated using normal, that is, non-superconducting materials. These materials have an inherent high loss, and the circuits formed therefrom possess varying degrees of loss. For resonant circuits, the loss is particularly critical. The Q of a device is a measure of its power dissipation or loss. Resonant circuits fabricated from normal metals in a micro strip or stripline configuration have Qs on the order of four hundred. ee, e.g., F. J. Winters, et al., "High Dielectric Constant Strip Line Band Pass Filters," IEEE Transactions On Microwave Theory and Techniques, Vol. 39, No. 12, December 1991, pp. 2182-87.

Microwave properties of high temperature superconductors (HTSCs) have improved substantially since their discovery, and various filter structures and resonators have been formed from HTSCs. See U.S. Pat. No. 5,616,538 to Hey-Shipton, et al. In many applications keeping filter structures to a minimum size is very important. This is particularly true of HTSC filters where the available size of usable substrates is generally limited. In the case of narrow-band microstrip filters (e.g., bandwidths of approximately 2 percent) this size problem may become quite severe.

FIG. 1 is an illustration of a prior art hairpin-resonator bandpass filter 10. See, M. Sagawa, et al., "Miniaturized Hairpin Resonator Filters and Their Application to Receiver Front-End MIC's," IEEE Trans. MTT, vol. 37, pp. 1991-1997 (December 1989). With reference to FIG. 1, the filter 10 may be thought of as an alternative version of the parallel coupled-resonator filter introduced by S. B. Cohn in "Parallel-Coupled Transmission-Line-Resonator Filters," IRE Trans. PGMTT, vol. MTT-6, pp. 223-231 (April 1958), except that the individual resonators 12 are folded back upon themselves. The orientations of the hairpin-resonators 12 may alternate (i.e., neighboring resonators face opposite directions) or the orientations of the hairpin-resonators 12 may be substantially similar (i.e., neighboring resonators face in similar directions). Additional resonators 12 may be provided to either side of the filter as represented by an ellipsis. The alternate orientation results in a strong coupling making this structure capable of considerable bandwidth. However, in the case of narrow-band filters, particularly for microstrip filters on a high-dielectric substrate, this structure is undesirable as it may require quite large spacings between the resonators 12 to achieve a desired narrow bandwidth.

FIG. 2 is a graph of a frequency response of the prior art hairpin-resonator filter of FIG. 1 having a passband of 10.44 GHz to 11.82 GHz. With reference to FIG. 2, The measured minimum loss in the passband was approximately −10.576 dB at 10.44 GHz and −9.869 dB at 11.82 GHz.

FIG. 3 is an illustration of another prior art hairpin-resonator filter 30. See, U.S. Pat. No. 5,055,809 to Sagawa, et al. and M. Sagawa, "Miniaturized Hairpin Resonator Filters and Their Application to Receiver Front-End MIC's," IEEE Trans. MTT, vol. 37, pp. 1991-1997 (December 1989). With reference to FIG. 3, the open-circuited ends 34 of the plural resonators 32 are considerably foreshortened and a capacitive gap 36 is provided to bring the remaining structure into resonance. The resonators 32 are then semi-lumped, with the lower portion 38 being inductive and the upper portion 39 being capacitive. The coupling between resonators 32 is almost entirely inductive, and it makes little difference whether adjacent resonators are inverted with respect to each other or not. Additional resonators 32 may be provided to either side of the filter as represented by an ellipsis. As illustrated in FIG. 3, the resonators 32 may possess the same orientation. If the resonators have sufficiently large capacitive loading, these resonator structures can be quite small, but, typically, their Q is inferior to that of a full hairpin resonator. Also, there will normally be no resonance effect in the region between the resonators so that the coupling mechanism cannot be used to generate poles of attenuation beside the passband in order to enhance the stopband attenuation.

Therefore, a need exists for compact, reliable, and efficient narrow-band filters possessing very high Q resonators. Despite the clear desirability of improved electrical circuits, including the known desirability of converting circuitry to include superconducting elements, room remains for improvement in devising alternate structures for filters. It has proved to be especially difficult to substitute HTSC in conventional circuits to form superconducting circuits without severely degrading the intrinsic Q of the superconducting films. Among the problems encountered are radiative losses and tuning, which remain despite the clear desirability of improved filters. As is described above, size has also remained a concern, especially for narrow-band filters. Also, power limitations arise in certain structures. Despite the clear desirability for forming microwave filters for narrow-band applications, to permit efficient use of the frequency spectrum, a need remains for improved designs capable of achieving those results in an efficient and cost effective manner.

Accordingly, there is a need for a method and apparatus for a novel hairpin microstrip bandpass resonator that would overcome the deficiencies of the prior art. Therefore, an embodiment of the present subject matter provides a microstrip filter having a plurality of hairpin microstrip resonators each having two substantially rectangular legs connected at one end and generally configured in a "U" shape. The microstrip filter comprises a plurality of resonators, a first resonator operatively connected to a first feed point and a second resonator operatively connected to a second feed point. A third of the plural resonators is operatively connected between the first and second resonators where an end portion of one of the legs of the resonators is tapered so that a thickness of the leg is greater at one end of the leg than at another end of the leg. The apparatus may further comprise a second plurality of resonators in place of the third resonator.

In another embodiment of the present subject matter an end portion of one of the legs of the third resonator may be tapered so that a thickness of a leg is greater at one end of the leg than at another end of the leg. An alternative embodiment of the present subject matter provides an end portion of one of the legs of the first resonator may tapered so that a thickness of the leg is greater at one end of the leg than at another end of the leg. In yet another embodiment, legs of the third and first resonators may also be tapered.

In yet another embodiment of the present subject matter a method is provided for increasing the operational bandwidth of a microstrip filter having a plurality of hairpin microstrip resonators each having two substantially rectangular legs connected at one end and generally configured in a "U" shape. The method comprises the steps of providing a first of the plural resonators operatively connected to a first feed point and providing a second of the plural resonators operatively connected to a second feed point. The method further comprises the steps of increasing a thickness of a portion of one leg of a third of the plural resonators such that a thickness of the one leg is greater at one end of the one leg than at another end of the one leg, and operatively connecting the third resonator between the first and second resonators. An alternative embodiment may interleave the legs of adjacent resonators and/or may substitute a second plurality of resonators for the third resonator.

In yet a further embodiment of the present subject matter, a microstrip filter is provided having a plurality of hairpin microstrip resonators each having two substantially rectangular legs connected at one end and generally configured in a "U" shape. The microstrip filter comprises a first of the plural resonators operatively connected to a first feed point, a second of the plural resonators operatively connected to a second feed point, and a third of the plural resonators operatively connected between the first and second resonators wherein the length of one of the legs of the third resonator is different than the length of one of the legs of the first or second resonators. An end portion of one of the legs of the plural resonators may also be tapered so that a thickness of the leg is greater at one end than at another end of the leg. Alternative embodiments of the filter may provide legs of the third resonator having a first length and the legs of the first or second resonators having a second length wherein the first and second lengths are not equal, and may substitute a second plurality of resonators for the third resonator.

Another embodiment of the present subject matter provides a method for shifting the center frequency of a microstrip filter having a plurality of hairpin microstrip resonators each having two substantially rectangular legs connected at one end and generally configured in a "U" shape. The method comprises the steps of providing a first of the plural resonators operatively connected to a first feed point, providing a second of the plural resonators operatively connected to a second feed point, changing the length of at least one of the legs of a third of the plural resonators, and operatively connecting the third resonator between said first and second resonators. An alternative method provides that the third resonator may further comprise a second plurality of resonators.

In yet another embodiment of the present subject matter, a microstrip filter is provided having a plurality of hairpin microstrip resonators each having two substantially rectangular legs connected at one end and generally configured in a "U" shape. The microstrip filter comprises a first of the plural resonators operatively connected to a first feed point, a second of the plural resonators operatively connected to a second feed point, and a third of the plural resonators operatively connected between the first and second resonators, where adjacent legs of adjacent plural resonators may be interleaved. A further embodiment may taper the legs of any number of the plural resonators.

An additional embodiment of the present subject matter provides a method for increasing the return loss of a microstrip filter having a plurality of hairpin microstrip resonators each having two substantially rectangular legs connected at one end and generally configured in a "U" shape. The method comprises the steps of operatively connecting a first of the plural resonators to a first feed point, providing a second of the plural resonators operatively connected to a second feed point, operatively connecting a third of the plural resonators between the first and second resonators, and interleaving adjacent legs of adjacent plural resonators. The method may also comprise the step of increasing a thickness of a portion of any of the legs of the plural resonators. The method may further comprise the step of maintaining a substantially constant distance between adjacent legs. An alternative embodiment may substitute a second plurality of resonators for the third resonator.

These embodiments and many other objects and advantages thereof will be readily apparent to one skilled in the art to which the invention pertains from a perusal of the claims, the appended drawings, and the following detailed description of the embodiments.

SUMMARY OF THE INVENTION

A microstrip filter having a plurality of hairpin microstrip resonators each having two substantially rectangular legs connected at one end and generally configured in a "U" shape. The microstrip filter may comprise a first of the plural resonators operatively connected to a first feed point, a second of the plural resonators operatively connected to a second feed point, and a third of the plural resonators operatively connected between the first and second resonators where an end portion of one of the legs of one of the resonators is tapered so that a thickness of the one leg is greater at one end of the one leg than at another end of the one leg.

DETAILED DESCRIPTION OF EXEMPLARY EMBODIMENTS

With reference to the figures where like elements have been given like numerical designations to facilitate an understanding of the present subject matter, the various embodiments of a method and apparatus for filtering a selected frequency band are herein described.

Figure 1:
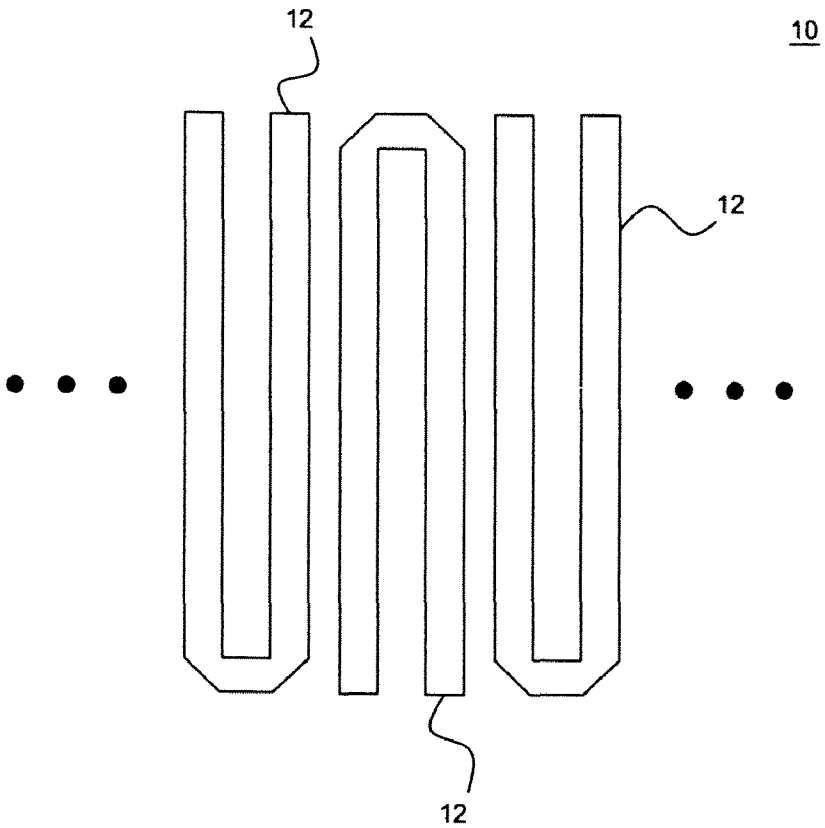
Figure 1 (Prior Art)
FIG. 1 is an illustration of a prior art hairpin-resonator bandpass filter.
Figure 2:
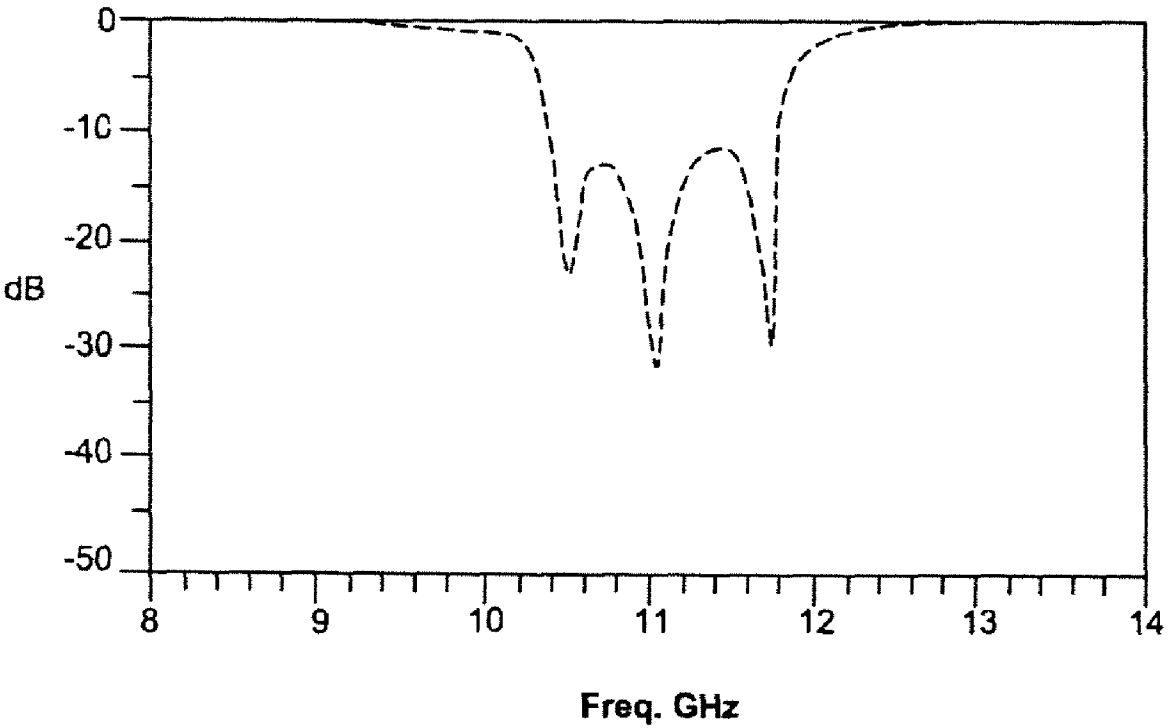
Figure 2 (Prior Art)
FIG. 2 is a graph of the frequency response of the prior art hairpin-resonator filter of FIG. 1.
Figure 3:
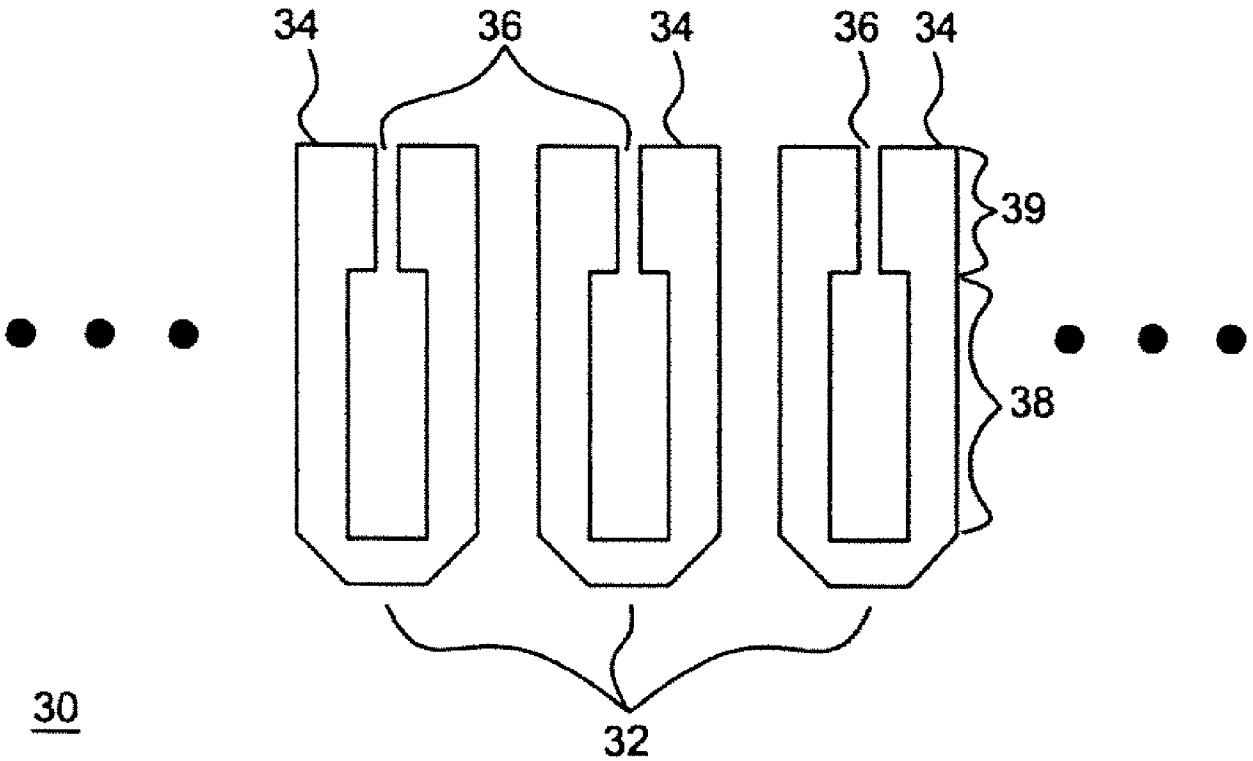
Figure 3 (Prior Art)
FIG. 3 is an illustration of a prior art hairpin-resonator filter.
Figure 4:
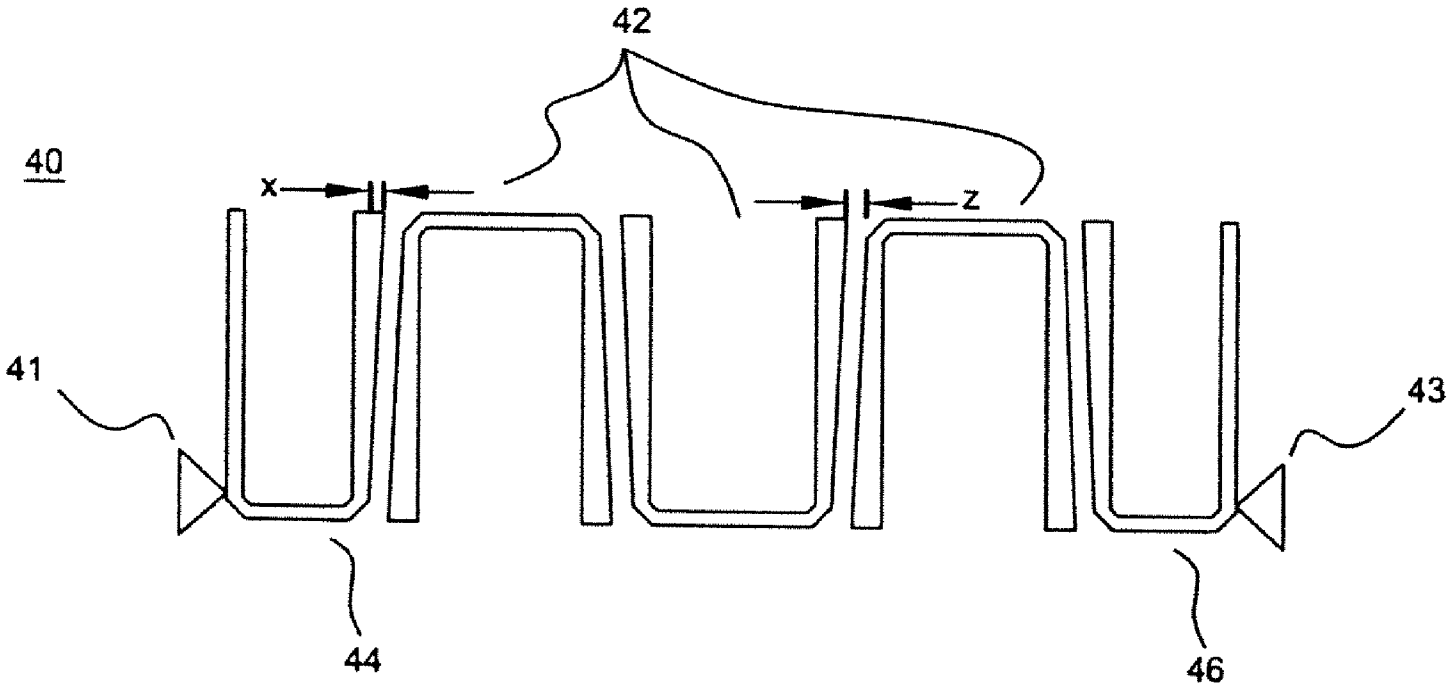
FIG. 4 is an illustration of a microstrip filter according to an embodiment of the present subject matter.

FIG. 4 is an illustration of a microstrip filter according to an embodiment of the present subject matter. With reference to FIG. 4, a microstrip filter 40 comprises a plurality of hairpin microstrip resonators each having two substantially rectangular legs connected at one end and generally configured in a "U" shape. A first of the microstrip resonators 44 may be operatively connected to a first feed point 41 and a second of the microstrip resonators 46 may be operatively connected to a second feed point 43. The first feed point 41 may provide a signal (not shown) to the filter 40 and the second feed point 43 may provide a filtered output signal (not shown) to external components. Of course, the second feed point may provide an input signal and the first feed point may provide a filtered output signal. A third of the microstrip resonators 42 may be operatively connected between the first and second resonators 44, 46. While FIG. 4 illustrates three microstrip resonators 42 operatively connected between the first and second resonators 44, 46, any number of microstrip resonators 42 (e.g., 1, 2, 3, 4, etc.) may be connected therebetween and such an illustration should not limit the scope of the claims appended herewith. The rectangular legs of the resonators may be substantially parallel to an opposing leg on the same resonator and/or substantially parallel to an adjacent leg on an adjacent resonator. In an alternative embodiment, adjacent legs of adjacent resonators may also be interleaved.

With reference to FIG. 4, at least one end portion of one leg of the resonators 42 may be tapered so that a thickness of the leg is greater by a width, x, at one end thereof than at the other end of the leg. Of course, any number or any combination of legs of individual or plural resonators 42 may be tapered. A plurality of taper widths, e.g., x=2.5 mil, 5 mil, 7.5 mil, or other values, may be utilized to vary a filter's response. Of course, the taper width, x, may not be constant for each resonator in the microstrip filter 40 and different resonators 42, 44, 46 may possess different taper widths; thus, such an illustration should not limit the scope of the claims appended herewith. For example, a plurality of resonators 42 may have a taper width, x, of 2.5 mil, while additional resonators 42, 44, 46 may have a taper width, x, of 7.5 mil in a microstrip filter 40 according to an embodiment of the present subject matter. Further the spacing, z, between adjacent resonators is substantially constant. While the spacing, z, is illustrated in FIG. 4 as the same for each set of adjacent resonators, a plurality of spacings, e.g., z1, z2, etc., may be utilized between different sets of adjacent resonators in an alternative embodiment of the present subject matter. Thus, by converting a rectangular geometry into a trapezoidal geometry, the resonators may be excited for wide range of frequencies resulting in an enhanced and/or wider bandwidth. Further, as the taper width, x, increases, the bandwidth may increase without adding additional area to the filter in comparison to a traditional hairpin filter. The taper width, x, may be applied to either the outside of the interior of the "U" shape of a resonator 42 or may be applied to the inside of the "U" shape. The taper may extend greater than ½ the length of a leg, or may extend .ltoreq.½ the length of a leg. Generally, the ratio of a tapered leg width to an untapered leg width may be between 1.305 and 1.595 and preferably 1.45.

Figure 5B:
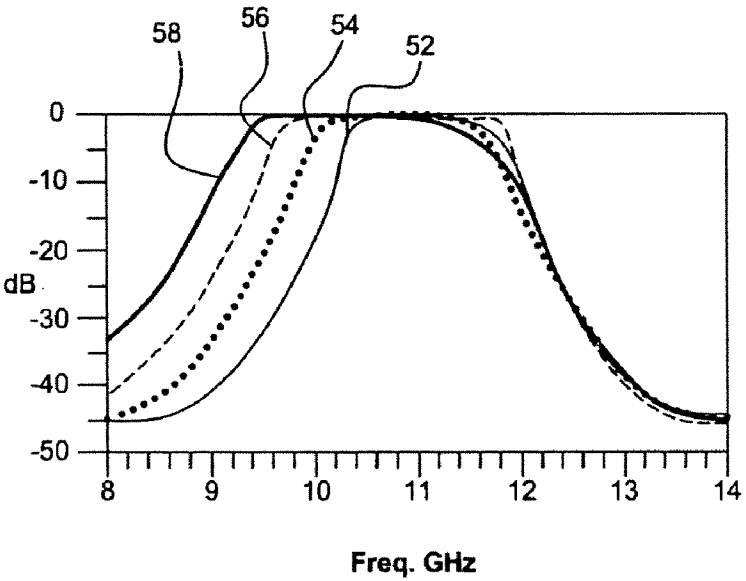
FIGS. 5A and 5B are graphs of the frequency response of the microstrip filter of FIG. 4.
Figure 5A:
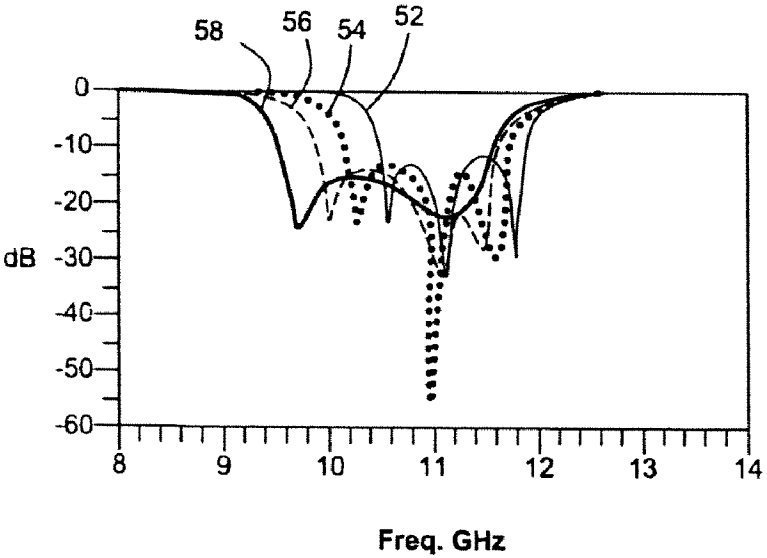

FIGS. 5A and 5B are graphs of the frequency response, i.e., return loss and insertion loss, respectively, of the microstrip filter of FIG. 4. With reference to FIGS. 5A and 5B, a frequency response of a traditional hairpin filter 52 and a microstrip filter according to embodiments of the present subject matter having taper widths of x=2.5 mil, 54, x=5 mil, 56, and x=7.5 mil, 58 are shown. Table 1 provides a tabulation of a bandwidth comparison between the traditional hairpin filter and the microstrip filters having differing taper widths. As illustrated in FIGS. 5A and 5B, the lower portion of a bandwidth may be varied and extended as a function of the taper width thus resulting in a wider bandwidth. Therefore, a significant bandwidth increase may be achieved without adding to the physical size of a respective filter. While taper widths of x=2.5, 5, and 7.5 mil and specific frequencies are shown in FIGS. 5A, 5B and Table 1, such an illustration is not intended to limit the scope of the claims appended herewith and embodiments of the present subject matter may be utilized with a wide range of taper widths and frequencies.

TABLE 1

| Filter Type | Low Frequency | High Frequency | 3 dB Bandwidth |
|---|---|---|---|
| Traditional Hairpin Filter | 10.36 GHz | 11.88 GHz | 1.52 GHz |
| Tapered Hairpin (x = 2.5 mil) | 10.03 GHz | 11.76 GHz | 1.73 GHz |
| Tapered Hairpin (x = 5 mil) | 9.703 GHz | 11.68 GHz | 1.977 GHz |
| Tapered Hairpin (x = 7.5 mil) | 9.355 GHz | 11.65 GHz | 2.295 GHz |

Figure 6:
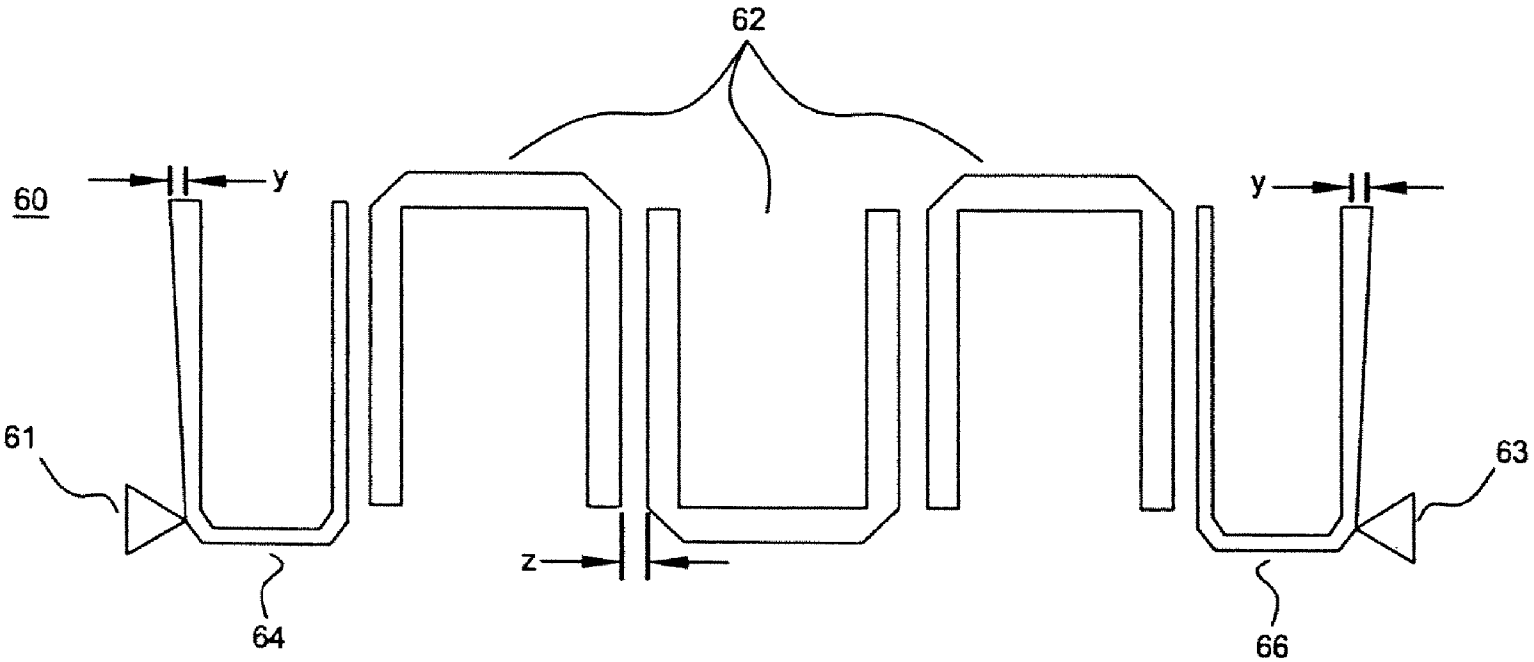
FIG. 6 is an illustration of a microstrip filter according to an additional embodiment of the present subject matter.

FIG. 6 is an illustration of a microstrip filter according to an additional embodiment of the present subject matter. With reference to FIG. 6, a microstrip filter 60 comprises a plurality of hairpin microstrip resonators each having two substantially rectangular legs connected at one end and generally configured in a "U" shape. A first of the microstrip resonators 64 may be operatively connected to a first feed point 61 and a second of the microstrip resonators 66 may be operatively connected to a second feed point 63. A third of the microstrip resonators 62 may be operatively connected between the first and second resonators 64, 66. While FIG. 6 illustrates three microstrip resonators 62 operatively connected between the first and second resonators 64, 66, any number of microstrip resonators 62 (e.g., 1, 2, 3, 4, etc.) may be connected therebetween and such an illustration should not limit the scope of the claims appended herewith. In an alternative embodiment, adjacent legs of adjacent resonators may also be interleaved.

As illustrated by FIG. 6, an end portion of one of the resonator legs of the first and/or second resonators 64, 66 may be tapered by a taper width, y, so that a thickness of the leg is greater at one end of the leg than at the other end of the leg. A plurality of taper widths, e.g., y=2.5 mil, 5 mil, or other values, may be utilized to vary a filter's response. Thus, by converting a rectangular geometry of an end resonator closest to a feed point into a trapezoidal geometry, the return loss of a microstrip filter 60 may be enhanced. The taper width, y, may be applied to either the outside of the interior of the "U" shape of a resonator 64, 66 or may be applied to the inside of the "U" shape. The taper may extend greater than ½ the length of a leg, or may extend .ltoreq.½ the length of a leg. Generally, the ratio of a tapered leg width to an untapered leg width may be between 1.53 and 1.87 and preferably 1.7.

Figure 7:
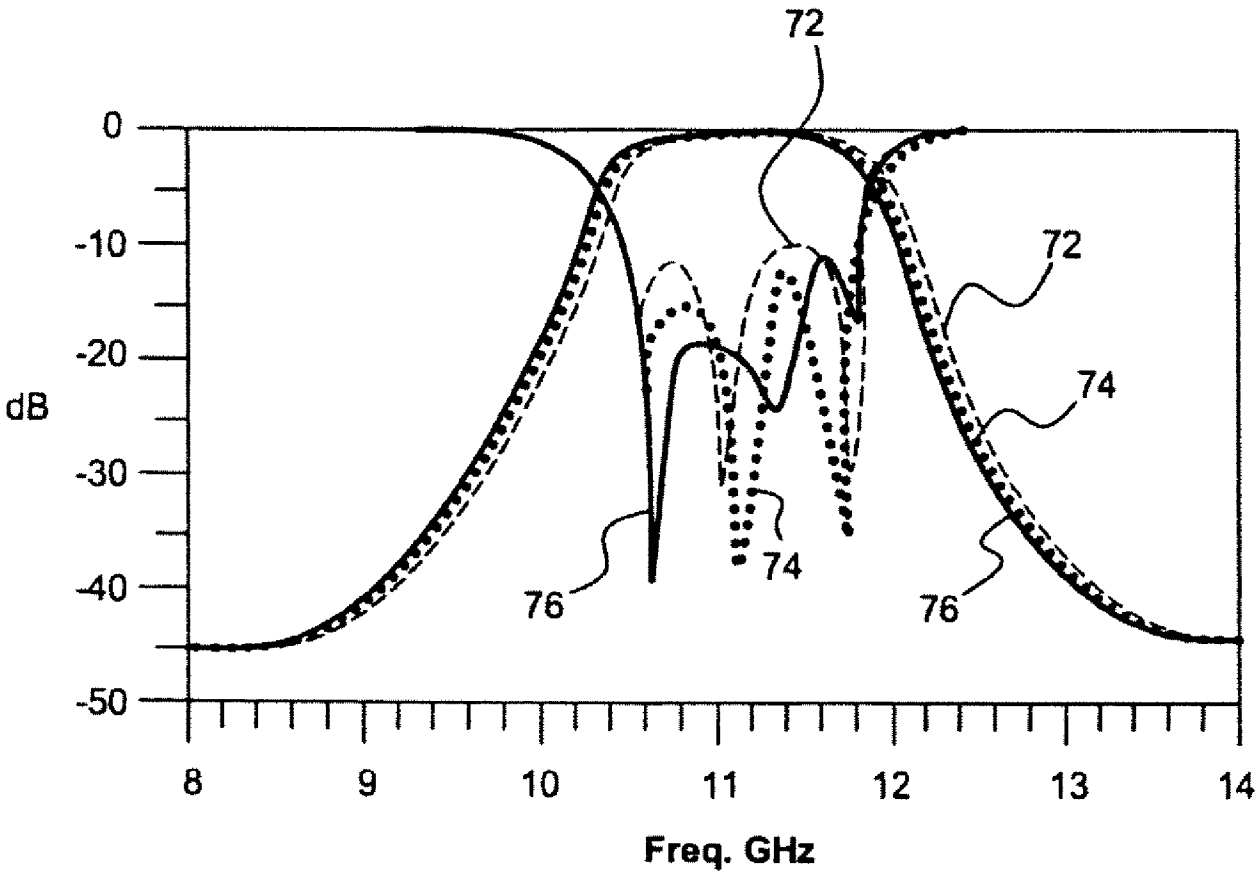
FIG. 7 is a graph of the frequency response of the microstrip filter of FIG. 6.

FIG. 7 is a graph of the frequency response of the microstrip filter of FIG. 6. With reference to FIG. 7, a frequency response of a traditional hairpin filter 72 and a microstrip filter according to embodiments of the present subject matter having taper widths of y=2.5 mil, 74, and y=5 mil, 76, are shown. As FIG. 7 illustrates, tapering the end resonators closest to a feed point provides an enhancement in return loss without increasing the physical size of a respective filter. While taper widths of y=2.5 and 5 mil and specific frequencies are shown in FIG. 7, such an illustration is not intended to limit the scope of the claims appended herewith and embodiments of the present subject matter may be utilized with a wide range of taper widths and frequencies.

Figure 8:
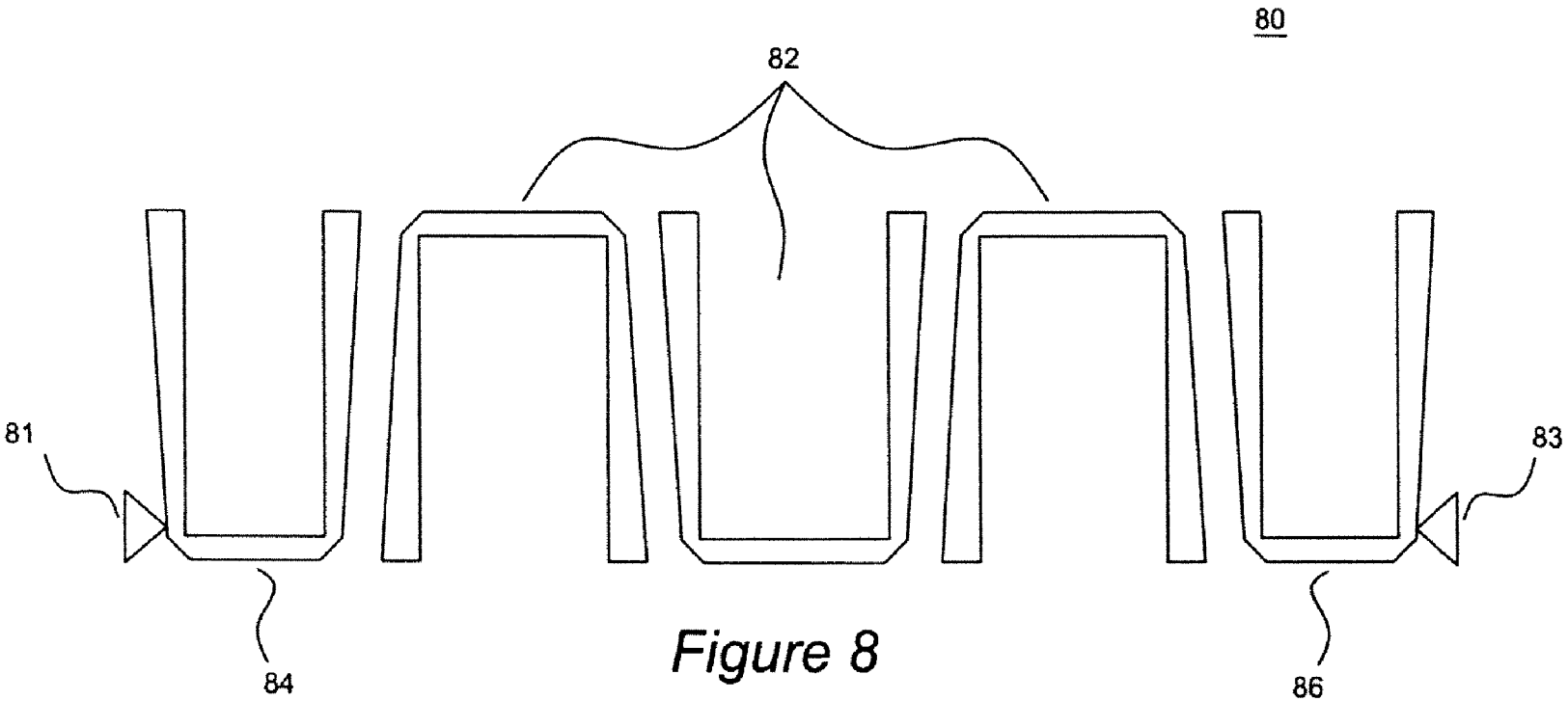
FIG. 8 is an illustration of a microstrip filter according to a further embodiment of the present subject matter.

FIG. 8 is an illustration of a microstrip filter according to a further embodiment of the present subject matter. With reference to FIG. 8, a microstrip filter 80 comprises a plurality of hairpin microstrip resonators each having two substantially rectangular legs connected at one end and generally configured in a "U" shape. A first of the microstrip resonators 84 may be operatively connected to a first feed point 81 and a second of the microstrip resonators 86 may be operatively connected to a second feed point 83. A third of the microstrip resonators 82 may be operatively connected between the first and second resonators 84, 86. While FIG. 8 illustrates three microstrip resonators 82 operatively connected between the first and second resonators 84, 86, any number of microstrip resonators 82 (e.g., 1, 2, 3, 4, etc.) may be connected therebetween and such an illustration should not limit the scope of the claims appended herewith. In an alternative embodiment, adjacent legs of adjacent resonators may also be interleaved.

With reference to FIG. 8, at least one end portion of one leg of the resonators 82 may be tapered so that a thickness of the leg is greater by a width, x, at one end thereof than at the other end of the leg. Of course, any number or any combination of legs of individual or plural resonators 82 may be tapered. Additionally, an end portion of one of the resonator legs of the first and/or second resonators 84, 86 may be tapered by a taper width, y, so that a thickness of the leg is greater at one end of the leg than at the other end of the leg. Of course, any number or any combination of legs of the first and/or second resonators 84, 86 may be tapered. The taper widths, x and y, may be also varied to alter a filter's response and may be applied to either the outside of the interior of the "U" shape of the respective resonators or may be applied to the inside of the "U" shape. Of course, the taper widths, x and/or y, may not be constant for each resonator in the microstrip filter 80 and different resonators 82, 84, 86 may possess different taper widths; thus, such an illustration should not limit the scope of the claims appended herewith. The tapers may extend greater than ½ the length of a leg, or may extend .ltoreq.½ the length of a leg. Generally, the ratio of a tapered leg width to an untapered leg width for the first and/or second resonators 84, 86 may be between 1.53 and 1.87 and preferably 1.7. Generally, the ratio of a tapered leg width to an untapered leg width for the third resonators 82 may be between 1.305 and 1.595 and preferably 1.45.

Figure 9B:
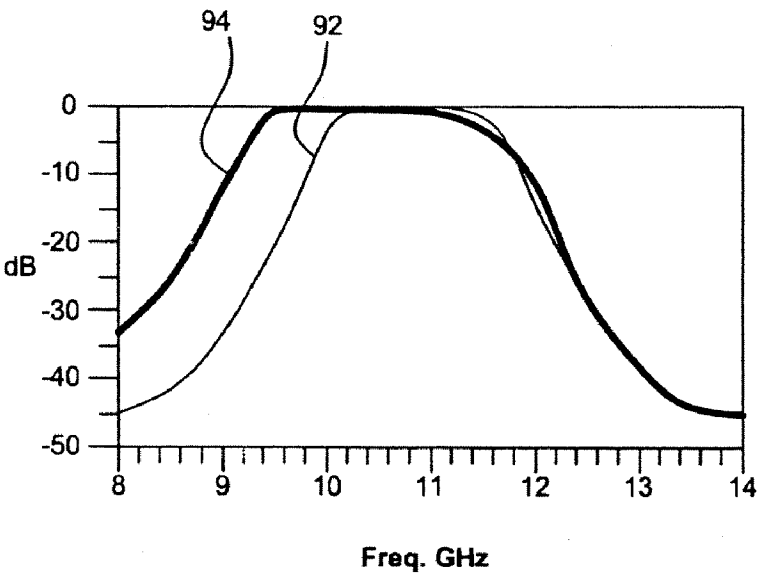
FIGS. 9A and 9B are graphs of the frequency response of the microstrip filter of FIG. 8.
Figure 9A:
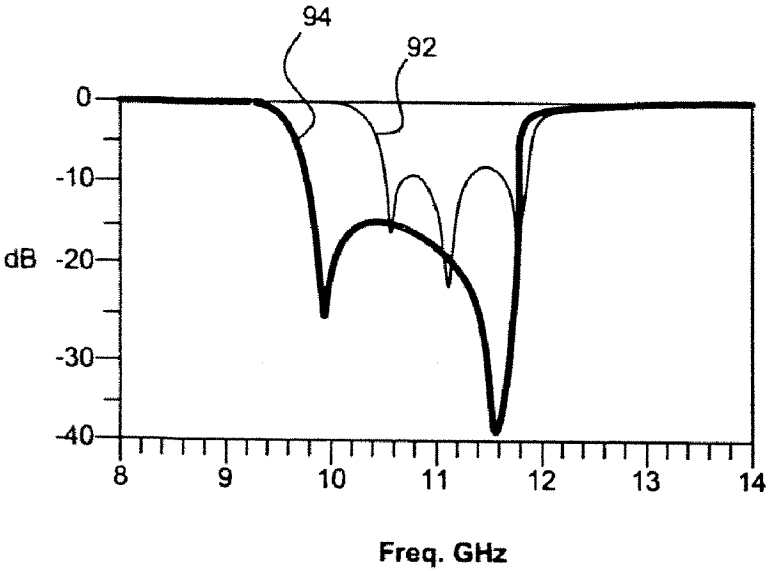

FIGS. 9A and 9B are graphs of the frequency response, i.e., return loss and insertion loss, respectively, of the microstrip filter of FIG. 8. With reference to FIGS. 9A and 9B, a frequency response of a traditional hairpin filter 92 and a microstrip filter according to an embodiment of the present subject matter having a taper width x=5 mil and a taper width y=2.5 mil, 94, are shown. Table 2 provides a tabulation of a bandwidth comparison between the traditional hairpin filter and the microstrip filter of FIG. 8. As FIGS. 9A and 9B illustrate, the 3 dB bandwidth may be increased from 1.52 GHz for the traditional filter to 2.022 GHz for the microstrip filter of the present subject matter thus providing a wider bandwidth on a lower frequency range. While taper widths of x=5 mil and y=2.5 and specific frequencies are shown in FIGS. 9A, 9B and Table 2, such an illustration is not intended to limit the scope of the claims appended herewith and embodiments of the present subject matter may be utilized with a wide range of taper widths and frequencies.

TABLE 2

| Filter Type | Low Frequency | High Frequency | 3 dB Bandwidth |
|---|---|---|---|
| Traditional Hairpin Filter | 10.36 GHz | 11.88 GHz | 1.52 GHz |
| Tapered Hairpin (x = 5 mil, y = 2.5 mil) | 9.688 GHz | 11.71 GHz | 2.022 GHz |

Figure 10:
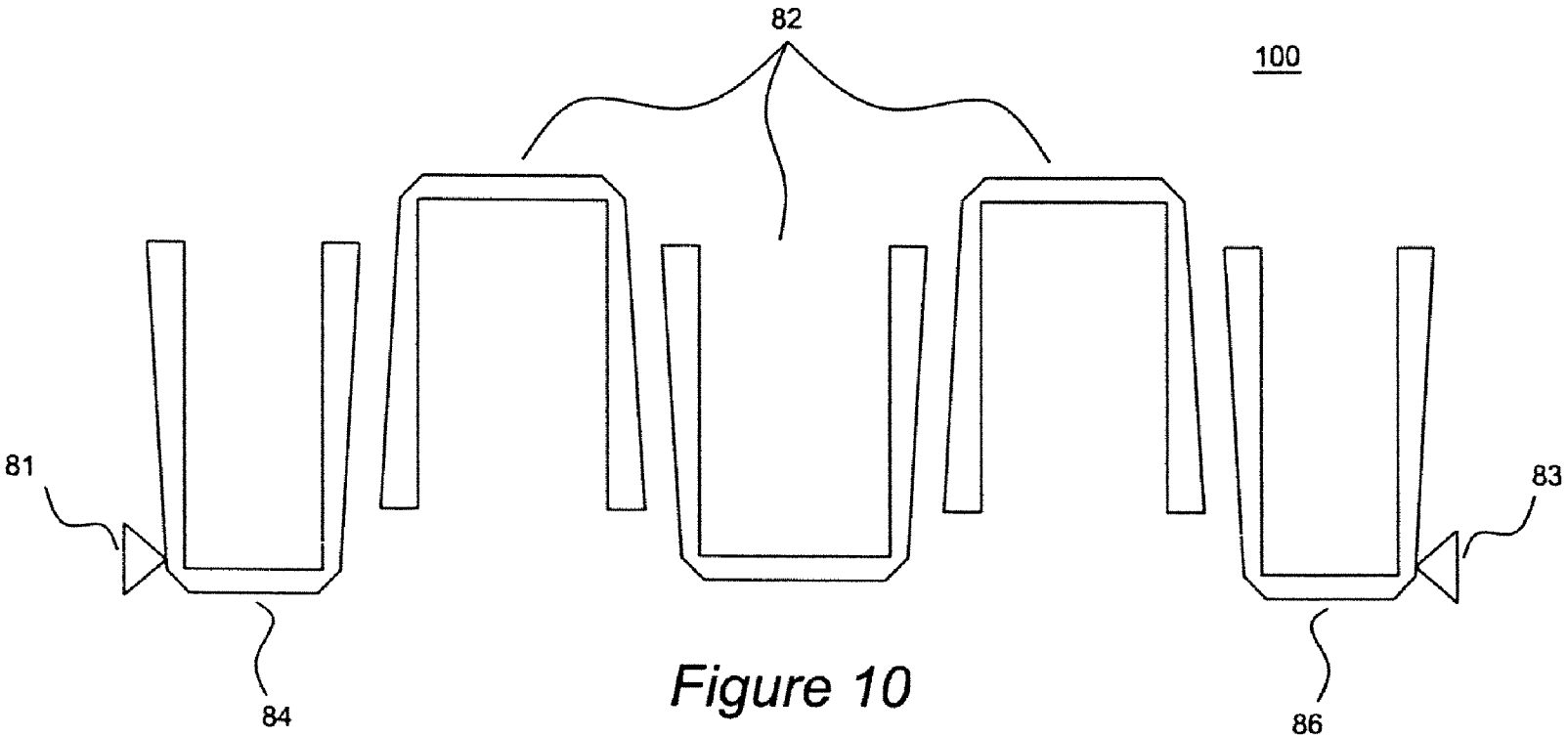
FIG. 10 is an illustration of a microstrip filter according to an alternative embodiment of the present subject matter.

FIG. 10 is an illustration of a microstrip filter according to an alternative embodiment of the present subject matter. With reference to FIG. 10, a microstrip filter 100 is shown with resonators having shortened leg lengths. Any number of the first, second and/or third resonators 82, 84, 86 may have leg lengths shortened. For example, the length of one of the legs of the third resonator 82 may be different than the length of one of the legs of the first or second resonators 84, 86. In an alternative embodiment, the shortened lengths of the legs of each resonator may be substantially the same as the lengths of the legs of the other resonators. Further, the legs of the third resonators 82 may have a first length and the legs of the first and/or second resonators 84, 86 may have a second length where the first and second lengths are not equal. For example, the length of the legs of the third resonator 82 may be less than the length of the legs of the first and/or second resonators 84, 86. Of course, the third resonator 82 may comprise a second plurality of resonators, and the length of any of the legs of the second plurality may be different than the length of one leg of the first or second resonators 84, 86, and the length of the legs of adjacent resonators may be different. With reference to FIG. 10, any number or any combination of legs of individual or plural resonators 82, 84, 86 may be tapered. In an alternative embodiment, adjacent legs of adjacent resonators may also be interleaved.

Figure 11B:
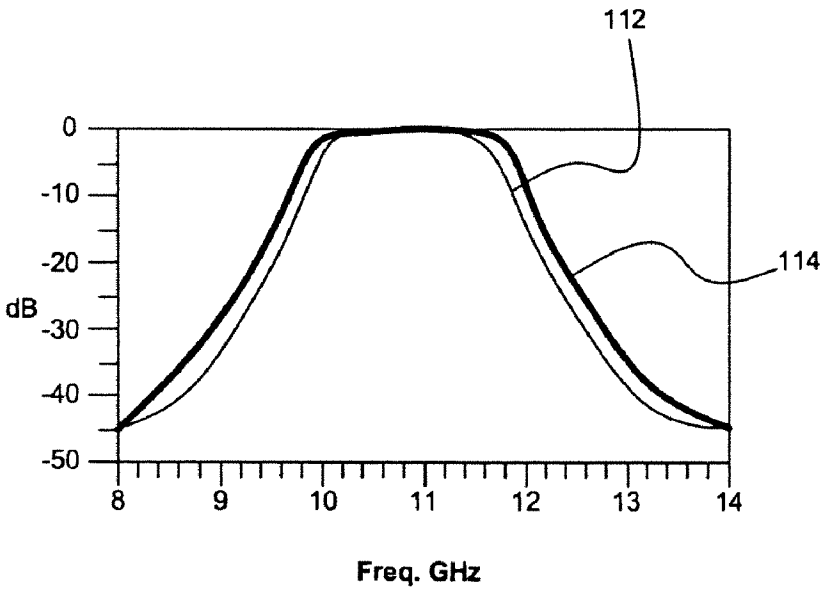
FIGS. 11A and 11B are graphs of the frequency response of the microstrip filter of FIG. 10.
Figure 11A:
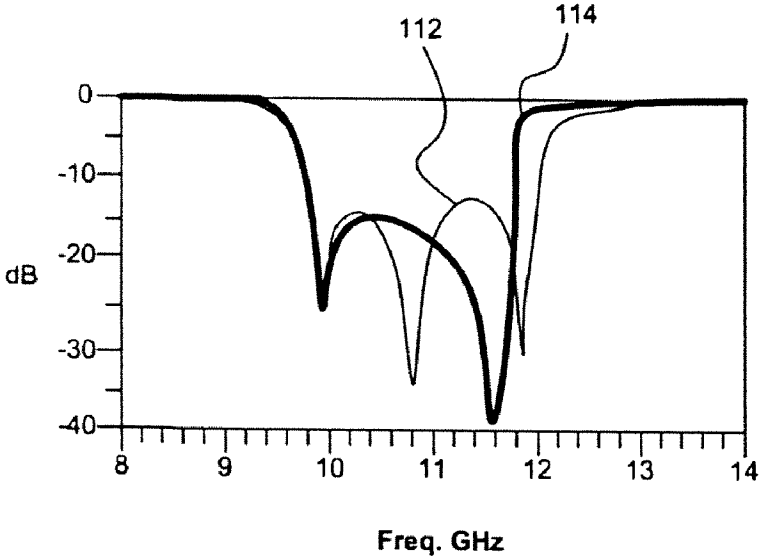

FIGS. 11A and 11B are graphs of the frequency response, i.e., return loss and insertion loss, respectively, of the microstrip filter of FIG. 10. With reference to FIGS. 11A and 11B, a frequency response of a traditional hairpin filter 112 and a microstrip filter according to an embodiment of the present subject matter having shortened legs 114 are shown. Table 3 provides a tabulation of a bandwidth comparison between the traditional hairpin filter and the microstrip filter 100 of FIG. 10. As FIGS. 11A and 11B illustrate the 3 dB bandwidth may be increased from 1.52 GHz to 1.94 GHz. Thus, by shortening the resonator lengths of the microstrip filter 100 the center frequency the microstrip filter 100 may be shifted. While not shown, an alternative embodiment of the present subject matter may also scale the size of the microstrip filter 100 to shift the center frequency. While FIGS. 11A, 11B and Table 3 are illustrated with specific frequencies, embodiments of the present subject matter may be utilized in a wide range of frequencies.

TABLE 3

| Filter Type | Low Frequency | High Frequency | 3 dB Bandwidth |
|---|---|---|---|
| Traditional Hairpin Filter | 10.36 GHz | 11.88 GHz | 1.52 GHz |
| Shifted Tapered Hairpin Filter | 10.24 GHz | 12.18 GHz | 1.94 GHz |

Figure 12:
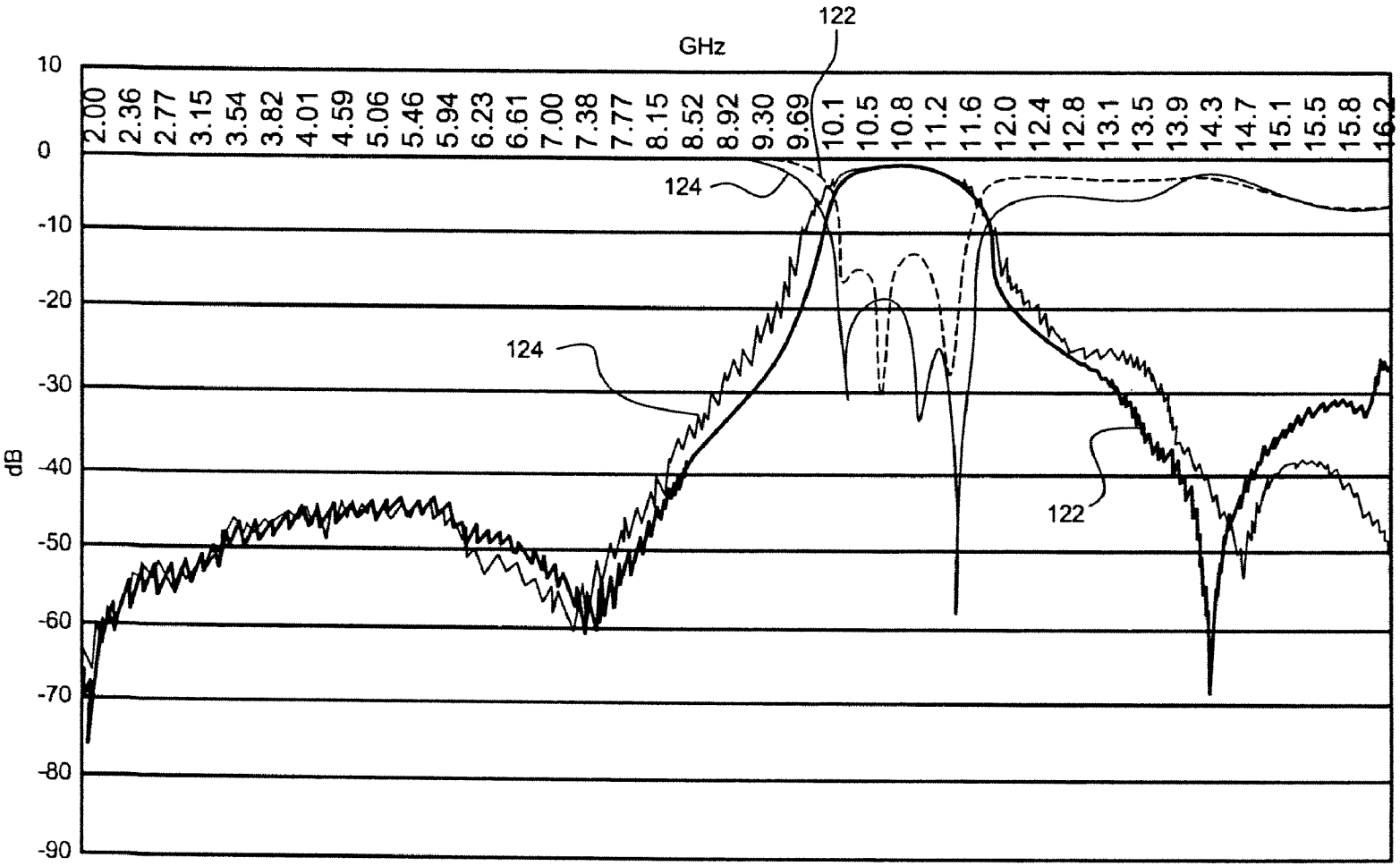
FIG. 12 is a graph comparing the frequency response of a fabricated traditional hairpin resonator filter and a microstrip filter according to an embodiment of the present subject matter.

FIG. 12 is a graph comparing the frequency response of a fabricated traditional hairpin resonator filter 122 and a microstrip filter 124 according to an embodiment of the present subject matter is shown. The filters were fabricated on a Rogers 4350 board having a relative permittivity of 3.48. As illustrated by FIG. 12, a microstrip filter according to an embodiment of the present subject matter enhances both the bandwidth and return loss through a tapering of resonator legs. Furthermore, such an approach provides an increased filter performance without enlarging the physical size of a respective filter. While FIG. 12 is illustrated with specific frequencies, embodiments of the present subject matter may be utilized in a wide range of frequencies.

Figure 13:
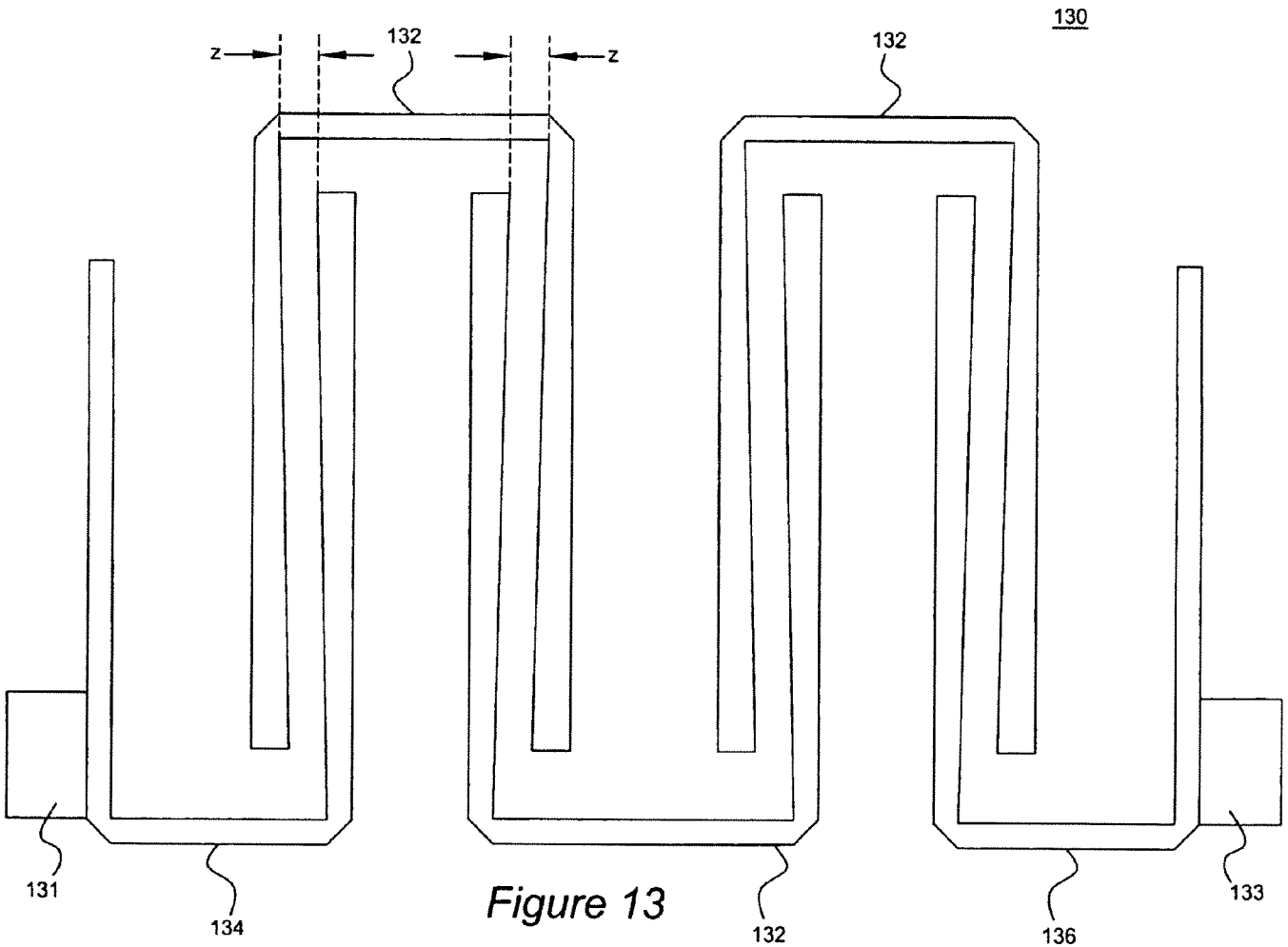
FIG. 13 is an illustration of a microstrip filter according to an alternative embodiment of the present subject matter.

FIG. 13 is an illustration of a microstrip filter according to an alternative embodiment of the present subject matter. With reference to FIG. 13, a microstrip filter 130 comprises a plurality of hairpin microstrip resonators each having two substantially rectangular legs connected at one end and generally configured in a "U" shape. A first of the microstrip resonators 134 may be operatively connected to a first feed point 131 and a second of the microstrip resonators 136 may be operatively connected to a second feed point 133. A third of the microstrip resonators 132 may be operatively connected between the first and second resonators 134, 136. While FIG. 13 illustrates three microstrip resonators 132 operatively connected between the first and second resonators 134, 136, any number of microstrip resonators 132 (e.g., 1, 2, 3, 4, etc.) may be connected therebetween and such an illustration should not limit the scope of the claims appended herewith. As illustrated by FIG. 13, the legs of the resonators may be substantially parallel to an opposing leg on the same resonator and/or substantially parallel to an adjacent leg on an adjacent resonator. Further, the adjacent legs of adjacent resonators may be interleaved. Even though the resonators are interleaved, the spacing, z, between adjacent resonators is substantially constant. While the spacing, z, is illustrated in FIG. 13 as the same for each set of adjacent resonators, a plurality of spacings, e.g, z1, z2, etc., may be utilized between different sets of adjacent resonators in an alternative embodiment of the present subject matter. For example, the spacing, z, between the resonators 132 and 134 may be different than the spacing, z, between the resonators 132 and 136. Of course, any number or any combination of legs of individual and/or plural resonators 132, 134, 136 may be tapered to vary the filter's response, and the taper widths, x and y, may be applied to either the outside of the interior of the "U" shape of the respective resonators or may be applied to the inside of the "U" shape. Of course, the taper widths, x and/or y, may not be constant for each resonator in the microstrip filter 130 and different resonators 132, 134, 136 may possess different taper widths; thus, such an illustration should not limit the scope of the claims appended herewith.

The tapers may extend greater than ½ the length of a leg, or may extend .ltoreq.½ the length of a leg. Generally, the ratio of a tapered leg width to an untapered leg width for the first and/or second resonators 134, 136 may be between 1.53 and 1.87 and preferably 1.7. Generally, the ratio of a tapered leg width to an untapered leg width for the third resonators 132 may be between 1.305 and 1.595 and preferably 1.45. In an alternative embodiment, the ratio of a leg length of a third resonator 132 to a leg length of a first and/or second resonator 134, 136 may be between 0.9775 and 1.3225 and preferably 1.15. Thus, the resonators may be excited for wide range of frequencies resulting in an enhanced and/or wider bandwidth. Further, as the taper widths, x and y, increases and/or the leg length ratio differs, the bandwidth may increase and the return loss enhanced without adding additional area to the microstrip filter in comparison to a traditional hairpin filter.

Figure 14A:
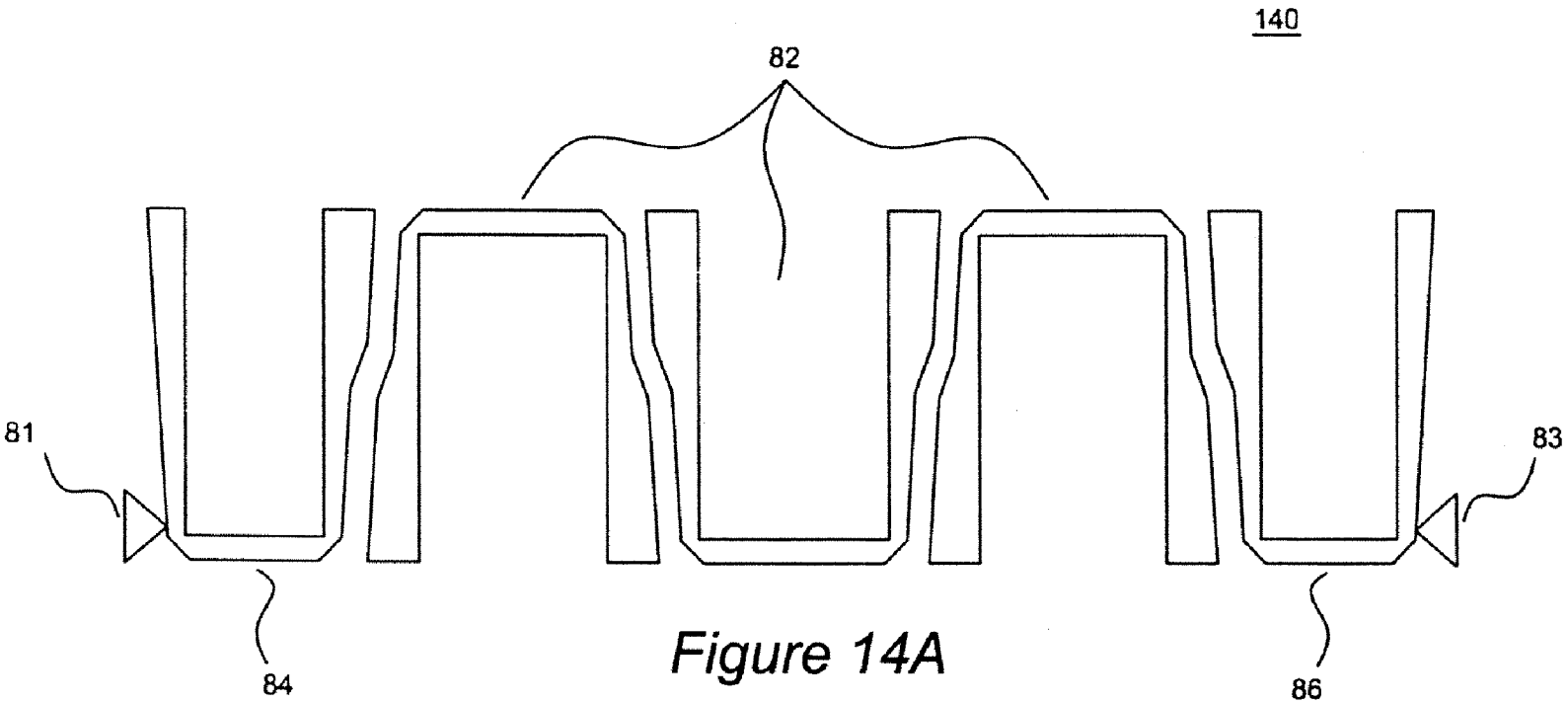
FIGS. 14A and 14B are illustrations of microstrip filters according to additional embodiments of the present subject matter.
Figure 14B:
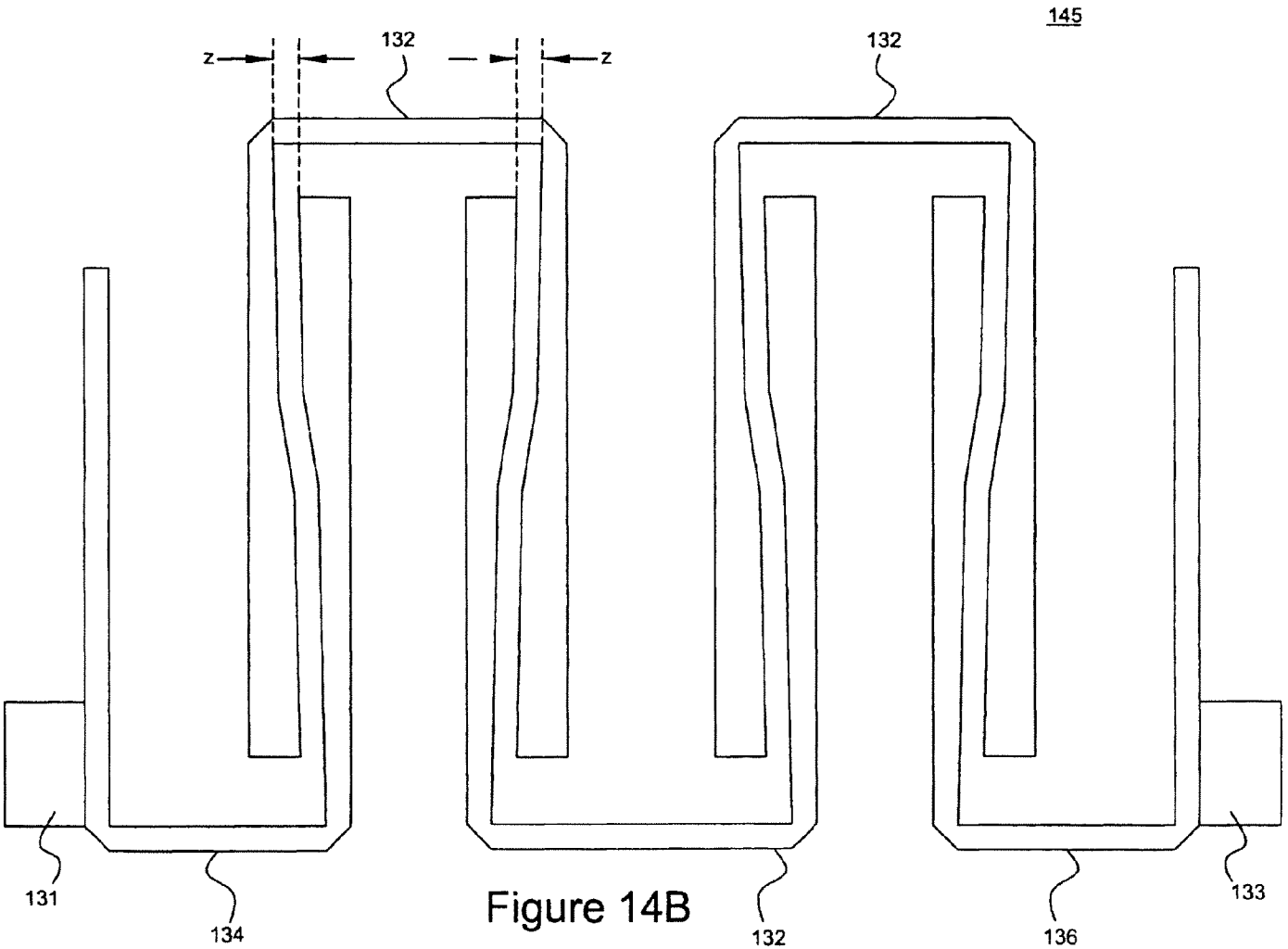

FIGS. 14A and 14B are illustrations of microstrip filters according to additional embodiments of the present subject matter. With reference to FIG. 14A, a microstrip filter 140 comprises a plurality of hairpin microstrip resonators each having two substantially rectangular legs connected at one end and generally configured in a "U" shape. At least one end portion of one leg of the resonators 82 may be tapered so that a thickness of the leg is greater by a width, x, at one end thereof than at the other end of the leg wherein the taper extends .ltoreq.½ the length of the leg. Of course, any number or any combination of legs of individual or plural resonators 82, 84, 86 may be tapered, and a combination of taper lengths (i.e., a taper length extending greater than ½ the length of a leg and a taper length extending .ltoreq.½ the length of a leg) may be utilized in a single microstrip filter.

With reference to FIG. 14B, a microstrip filter 145 comprises a plurality of hairpin microstrip resonators each having two substantially rectangular legs connected at one end and generally configured in a "U" shape. The adjacent legs of adjacent resonators may be interleaved, and at least one end portion of one leg of the resonators 132 may be tapered so that a thickness of the leg is greater by a width, x, at one end thereof than at the other end of the leg wherein the taper extends .ltoreq.½ the length of the leg. Even though the resonators are interleaved, the spacing, z, between adjacent resonators is substantially constant. While the spacing, z, is illustrated in FIGS. 14A and 14B, as the same for each set of adjacent resonators, a plurality of spacings, e.g., z1, z2, etc., may be utilized between different sets of adjacent resonators in an alternative embodiment of the present subject matter. Of course, any number or any combination of legs of individual or plural resonators 132, 134, 136 may be tapered, and a combination of taper lengths (i.e., a taper length extending greater than ½ the length of a leg and a taper length extending .ltoreq.½ the length of a leg) may be utilized in a single microstrip filter.

One embodiment of the present subject matter provides a microstrip filter having a plurality of hairpin microstrip resonators each having two substantially rectangular legs connected at one end and generally configured in a "U" shape. The microstrip filter comprises a plurality of resonators, a first resonator is operatively connected to a first feed point and a second resonator operatively connected to a second feed point. A third of the plural resonators is operatively connected between the first and second resonators where an end portion of one of the legs of the resonators is tapered so that a thickness of the leg is greater at one end of the leg than at another end of the leg. Of course, a second plurality of resonators may be substituted in place of the third resonator. Another embodiment of the present subject matter may taper an end portion of one of the legs of the third resonator so that a thickness of a leg is greater at one end of the leg than at another end of the leg. Further, an end portion of one of the legs of the first resonator may be tapered so that a thickness of the leg is greater at one end of the leg than at another end of the leg. Of course, any combination and number of the legs of the third and first resonators may also be tapered.

Another embodiment of the present subject matter provides a method for increasing the operational bandwidth of a microstrip filter having a plurality of hairpin microstrip resonators each having two substantially rectangular legs connected at one end and generally configured in a "U" shape. The method comprises the steps of providing a first of the plural resonators operatively connected to a first feed point and providing a second of the plural resonators operatively connected to a second feed point. The method further comprises the steps of increasing a thickness of a portion of one leg of a third of the plural resonators such that a thickness of the one leg is greater at one end of the one leg than at another end of the one leg, and operatively connecting the third resonator between the first and second resonators. An alternative embodiment may interleave the legs of adjacent resonators and/or may substitute a second plurality of resonators for the third resonator.

An alternative embodiment of the present subject matter provides a microstrip filter including a plurality of hairpin microstrip resonators each having two substantially rectangular legs connected at one end and generally configured in a "U" shape. The microstrip filter comprises a first of the plural resonators operatively connected to a first feed point, a second of the plural resonators operatively connected to a second feed point, and a third of the plural resonators operatively connected between the first and second resonators wherein the length of one of the legs of the third resonator is different than the length of one of the legs of the first or second resonators. An end portion of one of the legs of the plural resonators may also be tapered so that a thickness of the leg is greater at one end than at another end of the leg. Alternative embodiments of the filter may provide legs of the third resonator having a first length and the legs of the first or second resonators having a second length wherein the first and second lengths are not equal, and may substitute a second plurality of resonators for the third resonator.

Another embodiment of the present subject matter provides a method for shifting the center frequency of a microstrip filter having a plurality of hairpin microstrip resonators each having two substantially rectangular legs connected at one end and generally configured in a "U" shape. The method comprises the steps of providing a first of the plural resonators operatively connected to a first feed point, providing a second of the plural resonators operatively connected to a second feed point, changing the length of at least one of the legs of a third of the plural resonators, and operatively connecting the third resonator between said first and second resonators. An alternative method provides that the third resonator may further comprise a second plurality of resonators.

In yet another embodiment of the present subject matter, a microstrip filter is provided having a plurality of hairpin microstrip resonators each having two substantially rectangular legs connected at one end and generally configured in a "U" shape. The microstrip filter comprises a first of the plural resonators operatively connected to a first feed point, a second of the plural resonators operatively connected to a second feed point, and a third of the plural resonators operatively connected between the first and second resonators, where adjacent legs of adjacent plural resonators may be interleaved. A further embodiment may taper the legs of any number of the plural resonators.

An additional embodiment of the present subject matter provides a method for increasing the return loss of a microstrip filter having a plurality of hairpin microstrip resonators each having two substantially rectangular legs connected at one end and generally configured in a "U" shape. The method comprises the steps of operatively connecting a first of the plural resonators to a first feed point, providing a second of the plural resonators operatively connected to a second feed point, operatively connecting a third of the plural resonators between the first and second resonators, and interleaving adjacent legs of adjacent plural resonators. The method may also comprise the step of increasing a thickness of a portion of any of the legs of the plural resonators. The method may further comprise the step of maintaining a substantially constant distance between adjacent legs. An alternative embodiment may substitute a second plurality of resonators for the third resonator.

As shown by the various configurations and embodiments illustrated in FIGS. 1-14B, a method and apparatus for filtering a selected frequency band have been described.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A microstrip filter comprising:

a first of a plurality of hairpin microstrip resonators operatively connected to a first feed point, each of the plurality of hairpin microstrip resonators having two substantially rectangular legs connected at one end and generally configured in a "U" shape;

a second of said plural resonators operatively connected to a second feed point; and a third of said plural resonators operatively connected between said first and second resonators, wherein adjacent legs of adjacent plural resonators are interleaved.

2. The filter of claim 1 wherein said first feed point receives an input signal.

3. The filter of claim 1 wherein said second feed point provides an output signal.

4. The filter of claim 1 wherein said third resonator further comprises a second plurality of resonators.

5. The filter of claim 4 wherein the distance between said adjacent legs is substantially constant.

6. The filter of claim 1 wherein the ratio of a tapered leg width to an untapered leg width of said first resonator is between 1.53 and 1.87.

7. The filter of claim 6 wherein the ratio of a tapered leg width to an untapered leg width of said first resonator is approximately 1.7.

8. The filter of claim 1 wherein the ratio of a tapered leg width to an untapered leg width of said third resonator is between 1.305 and 1.595.

9. The filter of claim 8 wherein the ratio of a tapered leg width to an untapered leg width of said third resonator is approximately 1.45.

10. The filter of claim 1 wherein the ratio of a leg length of said third resonator to a leg length of said first resonator is between 0.9775 and 1.3225.

11. The filter of claim 10 wherein the ratio of a leg length of said third resonator to a leg length of said first resonator is approximately 1.15.

12. The filter of claim 1 wherein an end portion of one of the legs of said plural resonators is tapered so that a thickness of said one leg is greater at one end of said one leg than at another end of said one leg.

13. The filter of claim 12 wherein the thickness of said one leg is greater outside of the interior of said "U" shape.

14. The filter of claim 12 wherein the thickness of said one leg is greater on the interior of said "U" shape.

15. The filter of claim 12 wherein the distance between said adjacent legs is substantially constant.

16. A method for increasing the return loss of a microstrip filter, the method comprising:

operatively connecting a first of a plurality of hairpin microstrip resonators to a first feed point, each of the plurality of hairpin microstrip resonators having two substantially rectangular legs connected at one end and generally configured in a "U" shape;

providing a second of said plural resonators operatively connected to a second feed point;

operatively connecting a third of said plural resonators between said first and second feed points; and interleaving adjacent legs of adjacent plural resonators.

17. The method of claim 16 further comprising the step of maintaining a substantially constant distance between said adjacent legs.

18. The method of claim 16 wherein said third resonator further comprises a second plurality of resonators.

19. The method of claim 18 further comprising the step of maintaining a substantially constant distance between said adjacent legs.

20. The method of claim 16 further comprising the step of increasing a thickness of a portion of one leg of said plural resonators such that a thickness of said one leg is greater at one end of said one leg than at another end of said one leg.

21. The method of claim 20 wherein the thickness of said one leg is greater outside of the interior of said "U" shape.

22. The method of claim 20 wherein the thickness of said one leg is greater on the interior of said "U" shape.

* * * * *